US007980656B2

(12) United States Patent
Sakurai et al.

(10) Patent No.: US 7,980,656 B2
(45) Date of Patent: Jul. 19, 2011

(54) LIQUID EJECTION HEAD

(75) Inventors: Makoto Sakurai, Kawasaki (JP); Ichiro Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 12/485,234

(22) Filed: Jun. 16, 2009

(65) Prior Publication Data

US 2009/0315954 A1 Dec. 24, 2009

(30) Foreign Application Priority Data

Jun. 24, 2008 (JP) ..... 2008-164852

(51) Int. Cl.
*B41J 2/165* (2006.01)

(52) U.S. Cl. ..... 347/22; 347/23; 347/61; 347/63; 347/64

(58) Field of Classification Search ..... 347/61–65, 347/22, 23, 19
See application file for complete search history.

(56) References Cited

U.S. PATENT DOCUMENTS 4,723,129 A 2/1988 Endo et al.
4,740,796 A 4/1988 Endo et al.
6,485,132 B1 11/2002 Hiroki et al.
7,306,327 B2 12/2007 Sakai et al.
2007/0120902 A1 5/2007 Ozaki et al.
2007/0146428 A1 6/2007 Sakai et al.
2009/0315956 A1 12/2009 Ishida et al.

FOREIGN PATENT DOCUMENTS

JP 2008-105364 5/2008
KR KR-2007-0061440 * 6/2007

* cited by examiner

*Primary Examiner* — Matthew Luu
*Assistant Examiner* — Henok Legesse
(74) *Attorney, Agent, or Firm* — Fitzpatrick, Cella, Harper & Scinto

(57) ABSTRACT

On a liquid ejection head substrate, an upper protective layer, as well as coming into contact with a resin layer of a path forming member having an ejection opening, comes into contact with ink in a heat generating portion inside the channel formed. The upper protective layer contains iridium and silicon. The upper protective layer is configured so that, at a surface in contact with the ink and resin layer, $Ir_{100-X}Si_X$ attains a 15 at. %≦X≦30 at. % silicon content rate, and that X approaches zero as a position in the upper protective layer approaches an adhesion layer. As a result, at the interface where the upper protective layer comes into contact with the path forming member, by the silicon attaining the heretofore described content rate, it is possible to improve the adhesion with the path forming member made of resin compared with a case of using iridium alone.

7 Claims, 10 Drawing Sheets

LIQUID EJECTION HEAD

BACKGROUND OF THE INVENTION

1. Field of the Invention

The present invention relates to a liquid ejection head which ejects a liquid, and particularly relates to a layer which protects a heat generating portion in a liquid ejection head which ejects a liquid utilizing thermal energy.

2. Description of the Related Art

An ink ejection method described in U.S. Pat. No. 4,723,129, and in U.S. Pat. No. 4,740,796, is a method which ejects ink by utilizing thermal energy to cause an air bubble to form in the ink, and therefore enables a high speed, high image quality printing. Also, as this method is appropriate for colorization and downsizing, in recent years it has become a mainstream ink jet printing method.

A general configuration of a liquid ejection head using this method is one which includes a plurality of ejection openings, liquid paths communicating with the ejection openings, and electro-thermal converting elements which generate thermal energy utilized for ejecting ink. The electro-thermal converting element is configured to include a heating resistor and electrodes for supplying power thereto. Further, the electro-thermal converting elements are coated with a protective layer which has an electrical insulation property, so that an insulation property is secured for each electro-thermal converting element. Each liquid path communicates with a common liquid chamber, and ink is supplied to the common liquid chamber from an ink tank. The ink supplied to the common liquid chamber is led into each liquid path, and then forms a meniscus in the vicinity of the ejection opening to be held. The electro-thermal converting elements are selectively driven in this condition, and thermal energy is generated by the driven electro-thermal converting element. The generated thermal energy applies heat to ink rapidly through an ink contact portion (heat application portion) located above the electro-thermal converting element, to generate a bubble. Then, ink can be ejected by pressure of generated bubble.

The heat application portion of this type of liquid ejection head (hereafter called simply the "head"), as well as being exposed to a high temperature by the above described thermal energy generation, is multiply subjected to a physical action, such as the shock of a cavitation accompanying an expansion and a contraction of a bubble in ink, and a chemical action caused by the ink. Normally, a protective layer is provided in the heat application portion in order to protect the electro-thermal converting element from these effects. Conventionally, a protective layer of a tantalum film having a thickness of 0.2 to 0.5 μm is provided, in which the film is comparatively resistant to the shock of the cavitation and to the chemical action due to the ink.

Also, with the heat application portion, a phenomenon occurs whereby a coloring material, an additive, and the like contained in the ink are broken down to the molecular level by being heated to a high temperature to be changed to a hardly-soluble matter, and physically adsorbed onto the protective layer. This phenomenon is called cogation.

When a hardly-soluble organic matter or inorganic matter is adsorbed onto the protective layer due to the cogation, the transfer of heat from the heating resistor to the ink becomes uneven and the bubble generation becomes unstable. Therefore, the tantalum film, on which it is comparatively difficult for the cogation to occur, is generally used as the protective layer.

Hereafter, a description will be given, referring to FIG. 1, for conditions of generation and disappearance of a bubble in ink at the heat application portion.

A curved line (a) shown in FIG. 1 indicates a temporal change of surface temperature of a protective layer from a time point at which a drive voltage is applied to the heating resistor, in the case that the drive voltage Vop is taken to be 1.3×Vth (here, Vth indicates a bubble generation threshold voltage of the ink), a drive frequency 6 kHz, and a pulse width 5 μsec. On the other hand, a curved line (b) indicates by volume a development state of the generated bubble, likewise from the point at which the drive voltage is applied to the heating resistor. As shown by the curved line (a), a rise in temperature starts from the voltage being applied, reaches a peak temperature a little later than a set, predetermined pulse width (time) (because it takes a little longer for the heat from the heating resistor to reach the upper portion of the protective layer). After then, the temperature decreases due mainly to heat diffusion. Meanwhile, as shown by the curved line (b), the development of a bubble starts from a time point at which the protective layer surface temperature is around 300° C. and, after attaining a maximum volume, decreases its volume and disappears. These changes are caused repeatedly in an actually used head. In this way, it can be understood that the protective layer surface rises to a temperature of around, for example, 600° C. along with the generation of the bubble, and that the ink jet printing accompanies a high temperature thermal action. Then, this type of high temperature thermal action gives rise to the problem of cogation occurring.

In response to this problem, there are conventionally known countermeasures which make it difficult for cogation to occur by using ink containing a dye with a high heat resistance, or by using ink in which the amount of impurities in the dye is reduced by carrying out a sufficient refining. However, there are problems in that the manufacturing cost of the ink increases accordingly, the types of dye which can be used are limited, and the like.

That the above described problem arising due to the cogation are solved by a method differing from that which suppresses the occurrence of cogation is described in Japanese Patent Laid-Open No. 2008-105364. That is, in the document, it is described that, as well as using iridium (Ir) or ruthenium (Ru) for the protective layer which comes into contact with the ink, the protective layer is caused to be eluted so that the cogation is removed, by carrying out an electrolytic reaction.

However, although the method described in Japanese Patent Laid-Open No. 2008-105364 can effectively remove the cogation, regarding the above described protective layer formed on the head substrate, there is a difficulty relating to adhesion of the protective layer with a resin layer of a path wall or the like which are formed on the protective layer. As a result, a problem develops in that a detachment may occur between the members.

In particular, in the case of using an elongated (in particular, 0.5 inches or more) liquid ejection head in order to contribute to the recent speeding-up of printing, a comparatively large distortion occurs due to a difference in linear expansion coefficient between head composing members, stress of a resin layer forming the path wall and ejection opening, and the like. In this case, if there is a difficulty with the adhesion between the protective layer and the resin layer, the detachment may occur between the members. Also, in the case of using ink containing an additive for increasing the light resistance or gas resistance of the ink ejected onto the printing medium, this type of ink has an adverse effect on the interface between the members, and there may be the detachment occurring between the resin layer for forming the path wall or the like, and the protective layer. Furthermore, also in the case of providing an organic layer, for improving the adhesion, on the protective layer, it may happen that a detachment will occur around the interface between the adhesion improvement layer and protective layer. As a result, for example, there is a possibility that ink will seep onto the substrate, causing corrosion of the wiring, and it will be difficult to secure long-term quality and reliability of the liquid ejection head.

SUMMARY OF THE INVENTION

The object of the present invention is to provide a reliable liquid ejection head which, even if matters caused by cogation accumulates on a protective layer, can reliably remove the matters of cogation, and also improve the adhesion between the protective layer and a resin layer on the substrate.

In a first aspect of the present invention, there is provided a liquid ejection head having an ejection opening for ejecting a liquid, comprising: a substrate including a heat generating portion for generating thermal energy used for ejecting the liquid from the ejection opening, and a layer that is provided so as to cover said heat generating portion; and a member that is provided so as to be in contact with said layer, forms a liquid path communicating with the ejection opening between said substrate and said member, and is made of a resin, wherein at least two portions of the layer, one of which corresponds to the heat generating portion and the other of which is in contact with said member, contain Ir and Si, or contain Ru and Si.

According to the above described configuration, a protective layer contains mainly iridium (Ir) or ruthenium (Ru) which are metals that are eluted by an electrochemical reaction. The electrochemical reaction is caused in the protective layer so that a surface layer thereof is eluted, and thus it is possible to remove cogation on the heat generating portion evenly and reliably. Also, the protective layer contains silicon (Si), and thus it is possible to improve an adhesion property between a liquid path formation member of resin and the protective layer. As a result, it is possible to stabilize the long-term ejection property of the liquid ejection head.

Further features of the present invention will become apparent from the following description of exemplary embodiments (with reference to the attached drawings).

DESCRIPTION OF THE EMBODIMENT(S)

Figure 1:
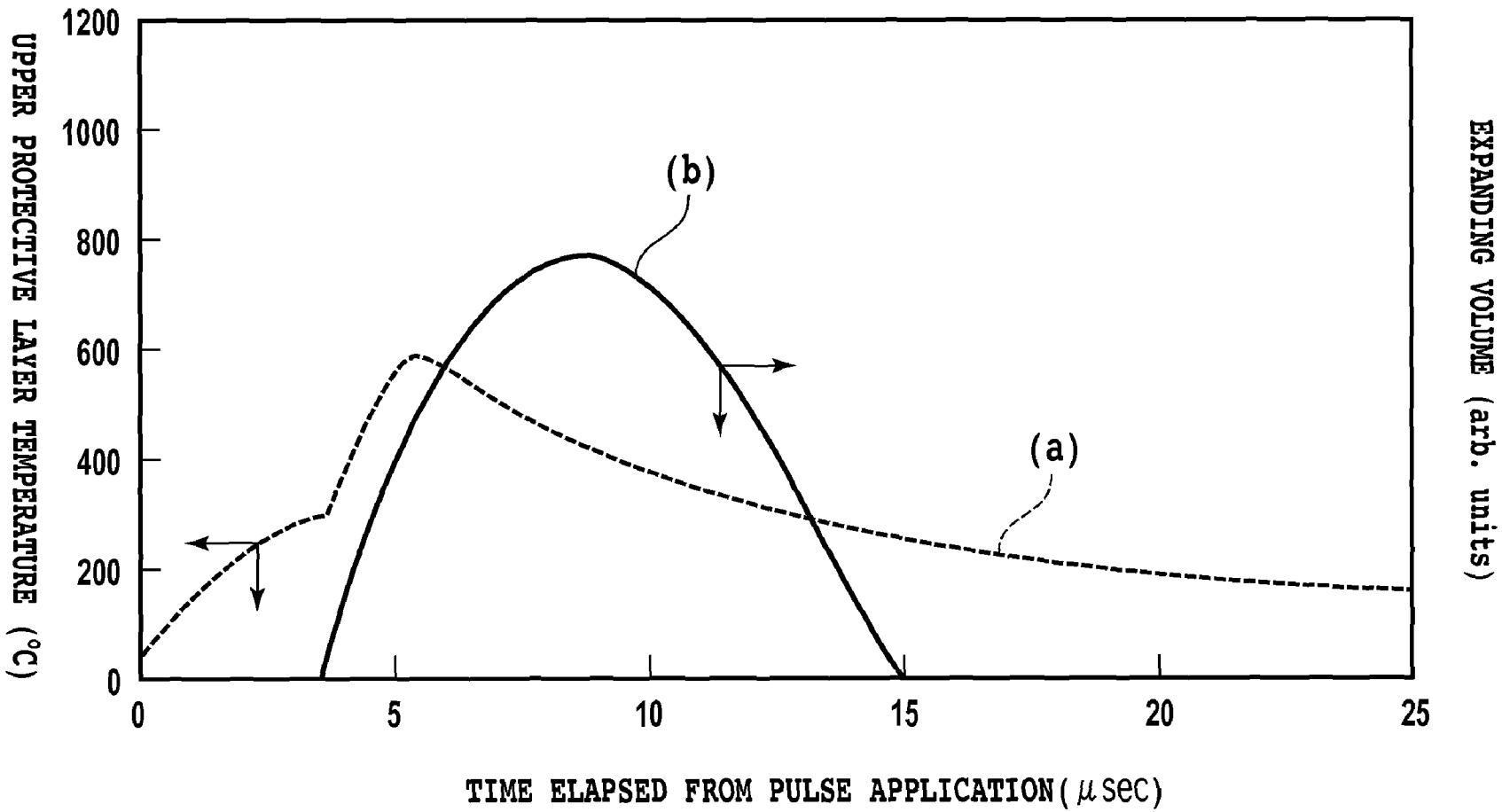
FIG. 1 is a diagram illustrating a temperature change of an upper protective layer, and a foaming condition, after applying a voltage to a heating resistor on a liquid ejection head substrate.

Hereafter, a detailed description of embodiments of the present invention will be given referring to the drawings.

Figure 2:
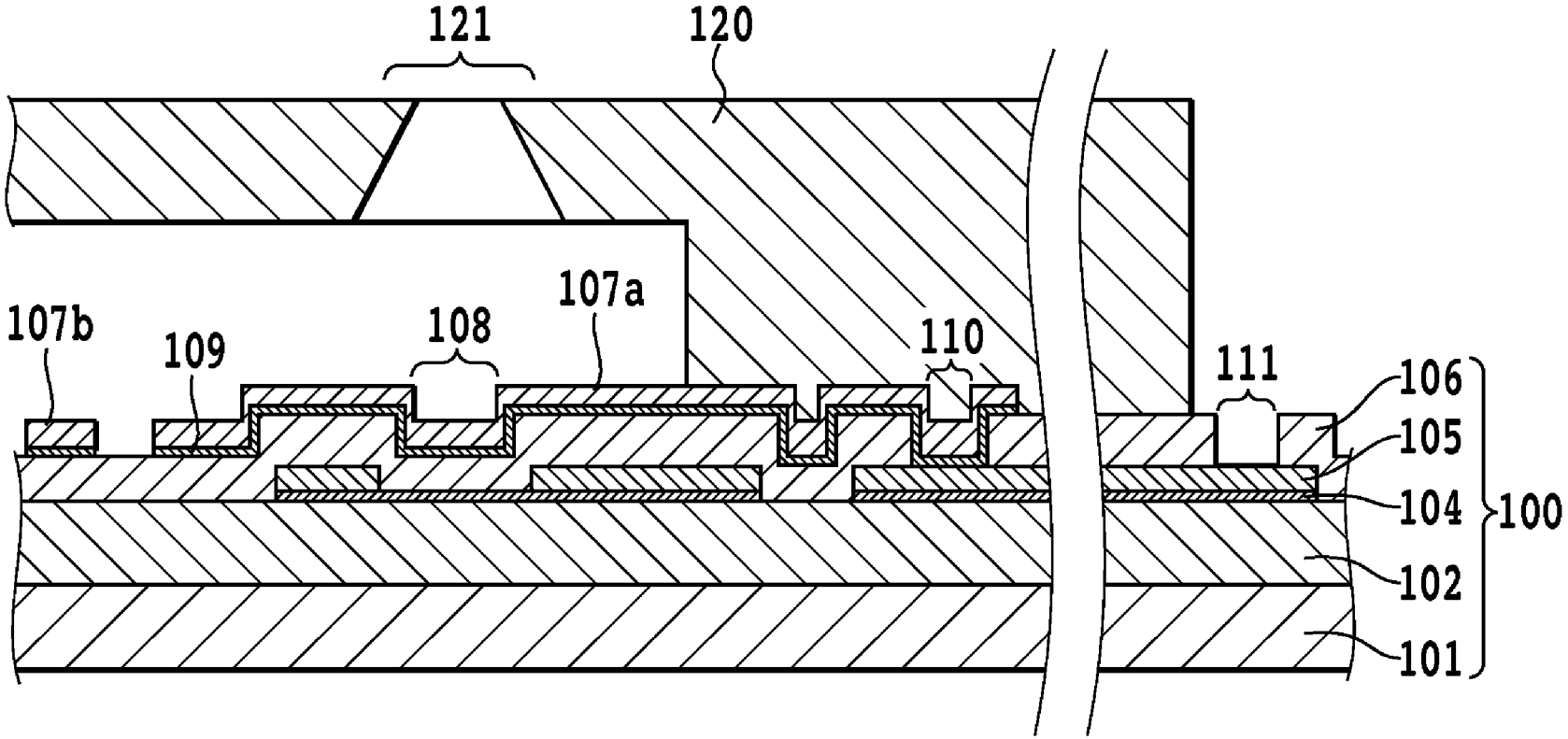
FIG. 2 is a partial sectional view of a liquid ejection head substrate according to one embodiment of the invention.
Figure 3:
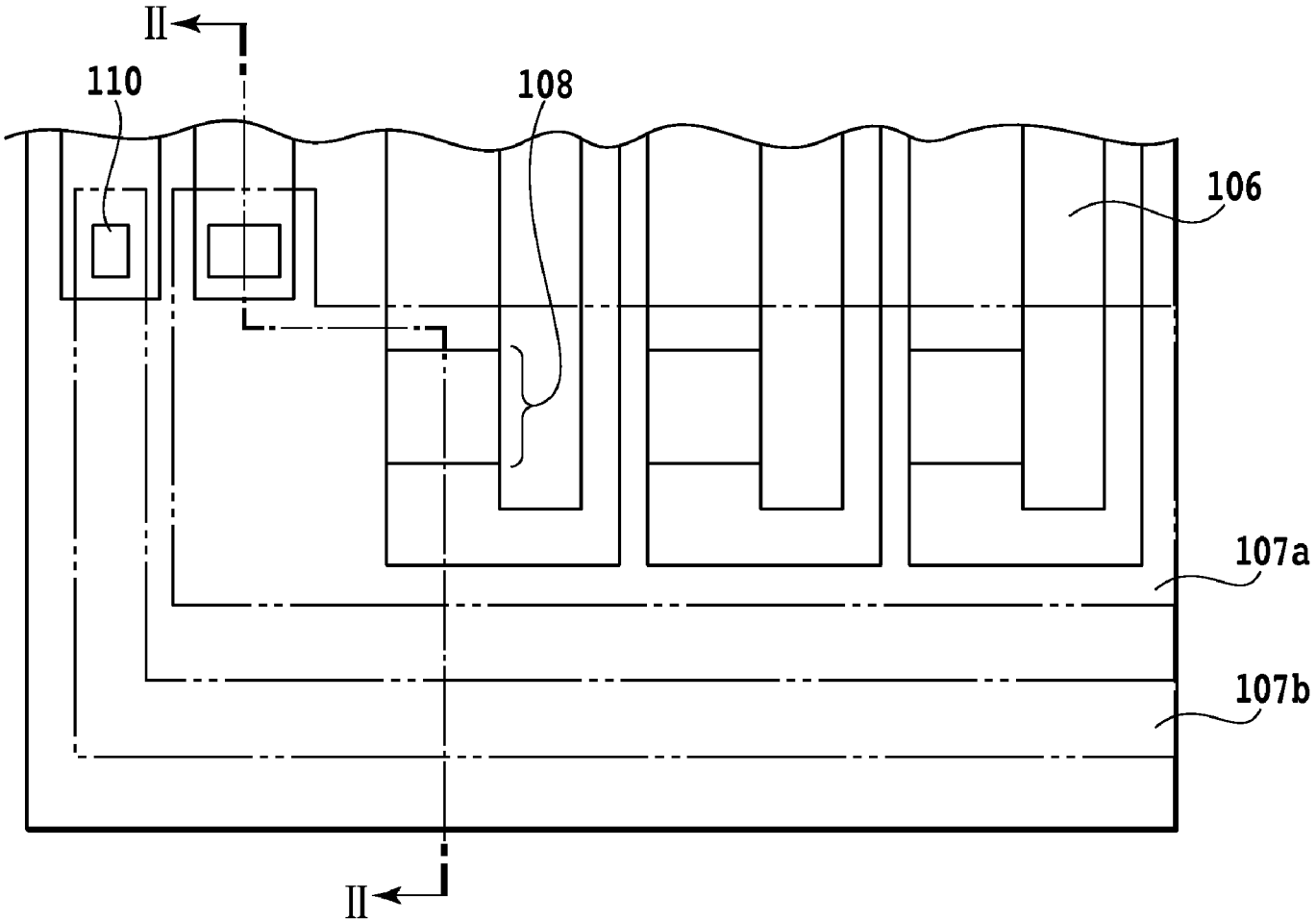
FIG. 3 is a plan view showing particularly the vicinity of a heat generating portion of the liquid ejection head substrate shown in FIG. 2.

FIG. 2 is a schematic partial sectional view showing an ink jet head to which a configuration of the present invention is applied. Also, FIG. 3 is a schematic plan view of the vicinity of a heat application portion in an ink jet head substrate according to the embodiment of the invention. FIG. 2 is a sectional view showing a state of the substrate that is cut vertically along a line II-II in FIG. 3.

In FIGS. 2 and 3, a reference numeral 101 denotes a silicon substrate. A reference numeral 102 denotes a thermal storage layer which can be formed of a thermally oxidized film, a silicon monoxide (SiO) film, a silicon nitride (SiN) film, or the like. A reference numeral 104 denotes a heating resistor layer, and a reference numeral 105 denotes an electrode wiring layer, which acts as wiring and is formed of a metal material such as aluminum, aluminum-silicon, or aluminum-copper. A heat generating portion 108 as an electro-thermal converting element is formed by removing a part of the electrode wiring layer 105 to form a gap and by exposing the heating resistor layer in that part through the electrode wiring layer. The electrode wiring layer 105 is connected to a not-shown driving element circuit or external power source terminal to receive a supply of power from the exterior. Although, in the example shown, the electrode wiring layer 105 is disposed on the heating resistor layer 104, it may be acceptable to employ a configuration wherein the electrode wiring layer 105 is formed on the substrate 101 or the thermal storage layer 102 and, after a part thereof is partially removed, forming a gap, the heating resistor layer is disposed.

A reference numeral 106 denotes a protective layer which is provided above the heat generating portion 108 and electrode wiring layer 105 and can be formed of a silicon monoxide film, a silicon nitride film, or the like, so as to function as a protecting layer. A reference numeral 107 denotes an upper protective layer which protects the electro-thermal converting element from a chemical or physical shock accompanying heat generation from the heat generating portion 108, and is eluted in order to remove the cogation at a time of a cleaning process. According to this embodiment, a metal which is eluted due to an electrochemical reaction in ink, specifically a metal containing iridium (Ir) or ruthenium (Ru) as a primary constituent and containing silicon, is used as the upper protective layer 107 (107*a* and 107*b*) which comes into contact with the ink. Thereby, as well as it being possible to effectively carry out the removal of the cogation, the adhesion between the upper protective layer and a resin layer forming a path wall, or the like, is improved, as will be described hereafter.

Of the upper protective layer 107, the upper protective layer 107*a* portion, in a position corresponding to the heat generating portion 108, acts as a heat application portion which causes heat generated by the heat generating portion 108 to act on the ink. A reference numeral 109 denotes an adhesion layer which is disposed between the protective layer 106 and the upper protective layer 107 to improve the adhesion of the upper protective layer 107 to the protective layer 106, and is formed using a material which has a conductive property. The upper protective layer 107 is electrically connected to the electrode wiring layer 105, through the adhesion layer 109, by means of a through hole 110. The electrode wiring layer 105 extends as far as an end of the ink jet head substrate, and a leading extremity thereof forms an external electrode 111 for carrying out an electrical connection with an exterior element.

A path forming member 120 is joined to the head substrate 100 having the above described configuration. The path forming member 120 includes an ejection opening 121 formed in a position corresponding to the heat application portion as well as a path communicating with the ink ejection opening 121 via the heat application portion, from an ink supply port provided penetrating the substrate 100.

The heat application portion of the liquid ejection head configured in the way heretofore described, as well as being exposed to a high temperature by the heat generation from the heating resistor, is a portion which is principally subjected to the shock of the cavitation accompanying expanding and contraction of a bubble after expanding, and a chemical action due to the ink. For this reason, the upper protective layer 107 is provided in the heat application portion in order to protect the electrothermal converting element from the shock of the cavitation and the chemical action due to the ink. Then, by the path forming member 120 being provided, an ejection element substrate, which includes the ejection opening 121 for ejecting the ink, is formed on the upper protective layer 107.

The embodiment utilizes an electrochemical reaction between the upper protective layer 107 and the ink in order to remove a deposit (cogation) on the heat generating portion 108. For this reason, the through hole 110 is formed in the protective layer 106, and the upper protective layer 107 and electrode wiring layer 105 are electrically connected through the adhesion layer 109. The electrode wiring layer 105 connects with the external electrode 111, because of which the upper protective layer 107 and the external electrode 111 are electrically connected.

Furthermore, the upper protective layer 107 is divided into two areas of the area 107*a* corresponding to the position of the heat generating portion 108 and the area 107*b* (the area of an opposing electrode side) excepting that area, and to each of the areas an electrical connection is made. When no solution exists on the substrate, the area 107*a* and the area 107*b* excepting this area are not electrically connected to each other. However, when a solution including an electrolyte, such as ink, exists on the substrate, a current flows through the solution. As a result of this, it is possible to cause an electrochemical reaction to occur at the interface between the upper protective layer 107 and the ink. Meanwhile, in the embodiment, the upper protective layer 107 is formed of $Ir_{100-x}Si_x$. It may be acceptable to form the upper protective layer 107 with $Ru_{100-x}Si_x$ instead of $Ir_{100-x}Si_x$. By forming the upper protective layer 107 with materials of these constituents, it is possible to cause a surface layer including the materials to be eluted by means of the above described electrochemical reaction. At this time, as the elution from the metal occurs on the anode electrode side, in order to remove the cogation on the heat generating portion 108, an electric potential is applied in such a way that the area 107*a* of the protective layer is on the anode side, and the area 107*b* is on the cathode side.

In the structure of the liquid ejection head, the upper protective layer 107, as well as coming into contact with the resin layer forming the path forming member in which the ejection opening is provided, comes into contact with the ink above the heat generating portion inside the path formed. This upper protective layer 107 is one wherein, at the same time as being required to have film properties superior in heat resistance, mechanical property, chemical stability, oxidation resistance, alkali resistance, and the like, an elution due to an electrochemical reaction is possible, as described above. Furthermore, the upper protective layer of the embodiment is one which has a superior adhesion to the path forming member, which is formed of an organic layer or resin for improving adhesion. The upper protective layer, in order to fulfill the above described conditions, includes iridium (Ir) or ruthenium (Ru), and silicon (Si), as described above. Preferably, the upper protective layer is configured in such a way that, at a surface in contact with the ink and path forming member, the $Ir_{100-X}Si_X$ or $Ru_{100-x}Si_x$ attains a 15 at. %≦X≦30 at. % silicon (Si) content rate, and that X approaches zero as a position in the upper protective layer more approaches the adhesion layer 109. The silicon content rate is fixed by a result of an evaluation test, to be described hereafter. As a result, by the silicon attaining the above described content rate of 15 at. %≦X≦30 at. % at the interface where the upper protective layer comes into contact with the path forming member, it is possible to improve the adhesion with the path forming member compared with a case of using iridium (Ir) or ruthenium (Ru) alone. Also, at a surface of the upper protective layer which comes into contact with the adhesion layer 109 at the side opposite to that described above, by reducing the silicon content, it is possible to ensure an adhesion between the upper protective layer 107 and the adhesion layer 109.

The film thickness of the upper protective layer 107 is selected from a range of 10 nm to 500 nm. Also, it is preferable that the film stress of the upper protective layer, having at least a compression stress, is $1.0\times10^{10}$ dyn/cm$^2$ or less. Although the upper protective layer 107 can be manufactured using various kinds of film formation method, generally it can be formed by means of a magnetron sputtering method using a high frequency (RF) power source, or a direct current (DC) power source.

Next, a description will be given of a manufacturing process of the liquid ejection head substrate according to the embodiment.

FIGS. 4A to 4F are schematic sectional views illustrating a manufacturing process of the liquid ejection head substrate shown in FIGS. 2 and 3, while FIGS. 5A to 5E are schematic plan views corresponding to FIGS. 4A to 4E respectively.

The manufacturing process below is one performed on the substrate 101 formed of silicon, or on a substrate into which is built, in advance, driving circuits that are configured of a semiconductor element such as a switching transistor, for selectively driving the heat generating portion 108. However, for the sake of simplification, the driving circuits and the like are omitted from the drawings.

Firstly, the thermal storage layer 102, configured of thermally oxidized film of a silicon dioxide ($SiO_2$), is formed on the substrate 101 as an under layer below the heating resistor layer 104, using a thermal oxidation method, a sputtering method, a CVD method, or the like. On the substrate into which the driving circuits are built in advance, it is possible to form the thermal storage layer during the manufacturing process of the driving circuits.

Figure 5A:
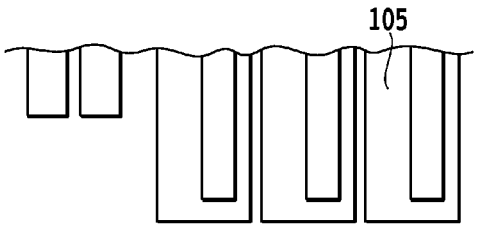
FIGS. 5A to 5E are schematic plan views corresponding to FIGS. 4A to 4E respectively.

Next, the heating resistor layer 104 of tantalum silicon nitride (TaSiN), or the like, is formed on the thermal storage layer 102, using a reaction sputtering, to a thickness of approximately 50 nm, and furthermore, an aluminum layer, which forms the electrode wiring layer 105, is formed using a sputtering to a thickness of approximately 300 nm. Then, the kind of sectional shape shown in FIG. 4R, and the kind of planar shape shown in FIG. 5A, are acquired by performing a dry etching on the heating resistor layer 104 and electrode wiring layer 105 simultaneously, using a photolithography method. In the embodiment, a reactive ion etching (RIE) method is used for the dry etching.

Figure 4A:
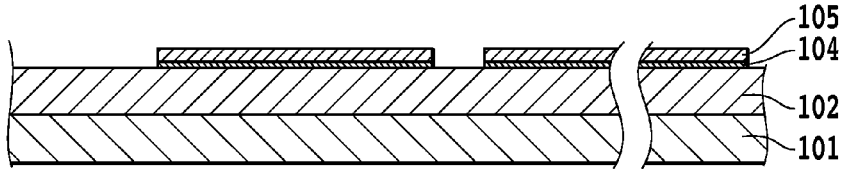
FIGS. 4A to 4F are schematic sectional views for illustrating a manufacturing process of the liquid ejection head substrate shown in FIGS. 2 and 3.
Figure 4B:
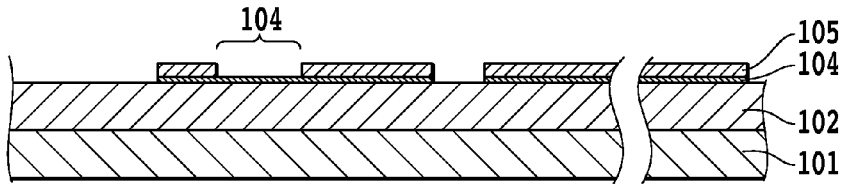
Figure 5B:
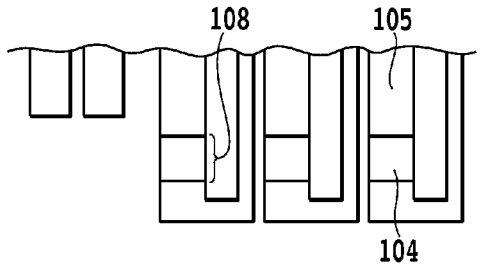

Next, using the photolithography method again, the aluminum electrode wiring layer 105 is partially removed by means of a wet etching, exposing that portion of the heating resistor layer 104, in order to form the heat generating portion 108, as shown in FIGS. 4B and 5B. In order to make the covering property of the protective layer 106 good at the wiring end, it is desirable to carry out a heretofore known wet etching with which an appropriate taper shape can be obtained at the wiring end.

Figure 4C:
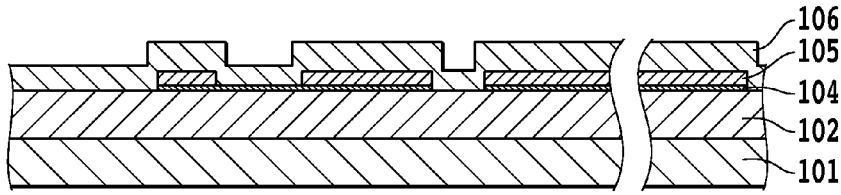
Figure 5C:
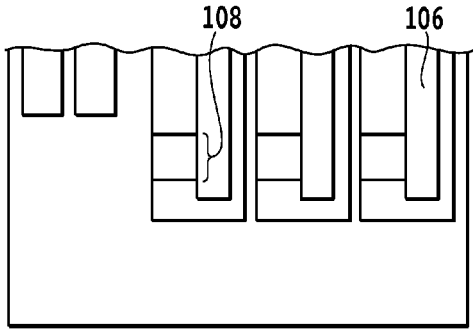

Subsequently, using a plasma CVD method, a silicon nitride (SiN) film is formed, as the protective layer 106, to a thickness of approximately 350 nm, as shown in FIGS. 4C and 5C.

Figure 4D:
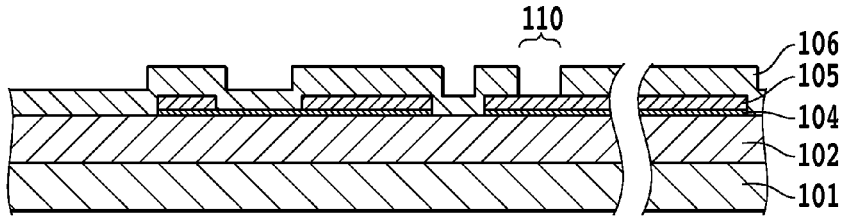
Figure 4E:
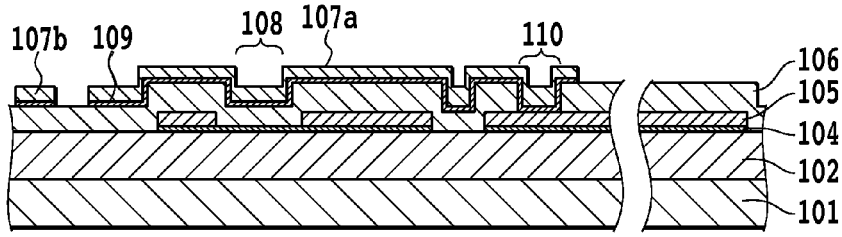
Figure 5D:
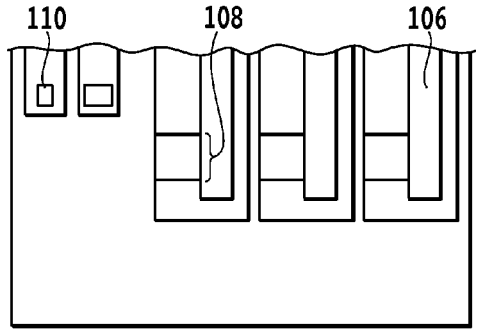
Figure 5E:
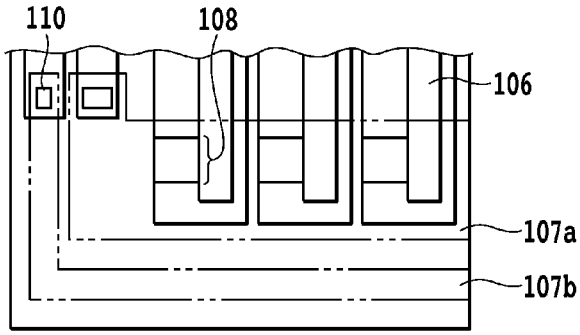

Next, using the photolithography method, the kind of dry etching shown in FIGS. 4D and 5D is carried out in order to form the through hole 110 for bringing the upper protective layer 107 and electrode wiring layer 105 into electrical contact. By this means, the silicon nitride film is partially removed, exposing that portion of the electrode wiring layer 105.

Next, a tantalum layer is formed on the protective layer 106 to a thickness of approximately 50 nm, using a sputtering, as the adhesion layer 109 which improves the adhesion of the protective layer 106 to the upper protective layer 107.

Next, an $Ir_{100-x}Si_x$ or $Ru_{100-x}Si_x$ layer is formed on the adhesion layer 109 to a thickness of approximately 200 nm, using a sputtering, as the upper protective layer 107. Hereafter, a description will be given of one example of a method of forming the upper protective layer made of $Ir_{100-x}Si_x$.

Figure 6:
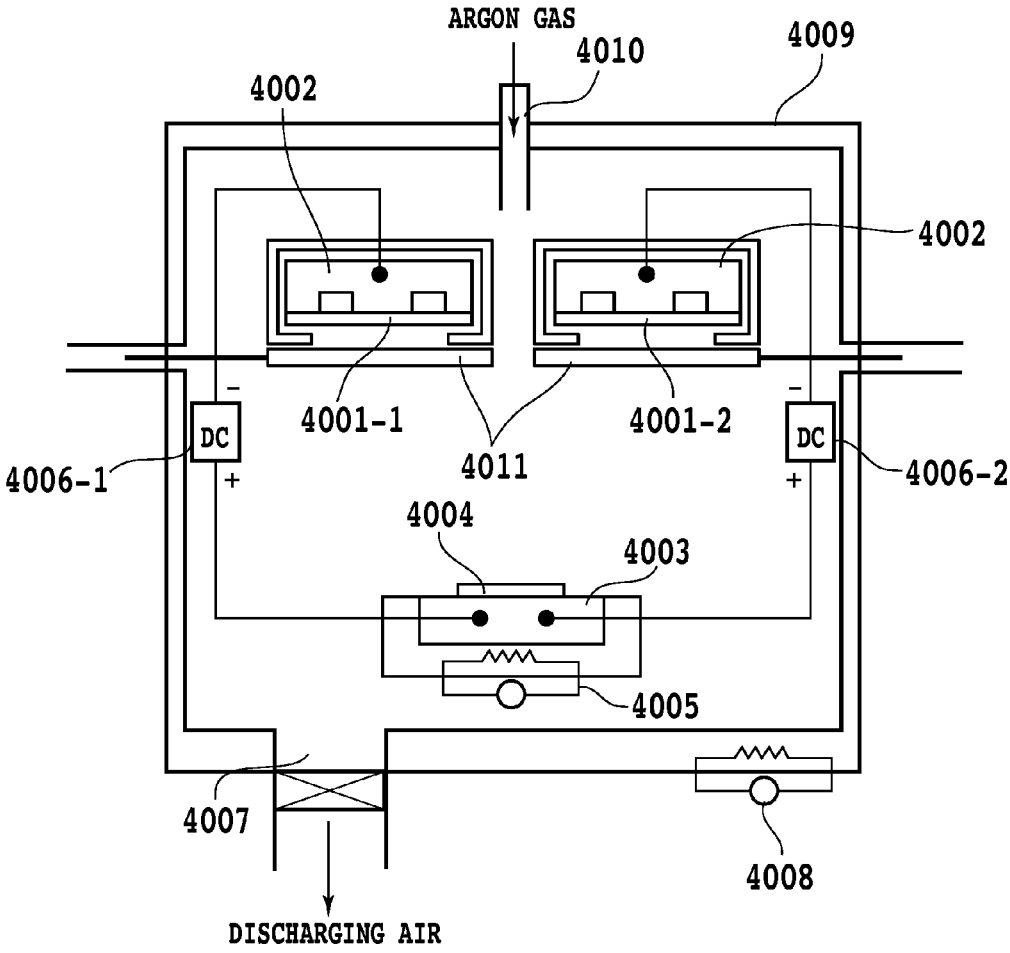
FIG. 6 is a diagram schematically showing a film forming apparatus which forms a film of each layer of the liquid ejection head substrate according to the embodiment of the invention.

FIG. 6 is a diagram showing an outline of a sputtering apparatus for a film formation of the upper protective layer 107. In FIG. 6, a reference sign 1001-1 denotes an iridium (IR) target, 4001-2 a silicon (Si) target, 4002 plate magnets, and 4011 shutters controlling a formation of a film on a substrate. Also, a reference sign 4003 denotes a substrate holder, and 4004 a substrate. Furthermore, a reference sign 4006-1 denotes a power source connected to the target 4001-1 and substrate holder 4003, and a reference sign 4006-2 denotes a power source connected to the target 4001-2 and substrate holder 4003. Furthermore, a reference sign 4008 denotes, in FIG. 6, an external heater provided surrounding the external wall of a film formation chamber 4009, and the external heater 4008 is used to adjust the ambient temperature of the film formation chamber 4009. An internal heater 4005, which carries out temperature control of the substrate, is provided on the rear surface of the substrate holder 4003. It is preferable that the temperature control of the substrate 4004 is carried out in combination with the external heater 4008.

The film formation using the apparatus of FIG. 6 is carried out as follows. Firstly, using an air discharge pump 4007, air is evacuated from the film formation chamber 4009 until the pressure is $1\times10^{-5}$ Pa to $1\times10^{-6}$ Pa. Next, argon gas is introduced via a mass flow controller (not shown), through a gas inlet 4010, into the film formation chamber 4009. At this time, the internal heater 4005 and external heater 4008 are controlled so that the substrate temperature and ambient temperature reach a predetermined temperature. Next, a predetermined power is applied from the power source 4006-1 to the target 4001-1, and from the power source 4006-2 to the target 4001-2, a sputtering discharge is carried out, the shutters 4011 are adjusted, and a thin film is formed on the substrate 4004.

When forming the upper protective layer 107, it is possible to obtain a strong film adhesion by heating the substrate to a temperature of 100° C. to 300° C., as described above. Also, by forming the film using the sputtering method, which can form particles with a comparatively large kinetic energy, it is possible to obtain a strong film adhesion. Furthermore, by making the film stress, having at least a compression stress, $1.0\times10^{10}$ dyn/cm$^2$ or less, it is also possible to obtain a strong film adhesion. The film stress can be adjusted by appropriately setting the flow of the argon gas introduced into the film forming apparatus, the power applied to the targets, and the substrate heating temperature.

With the above described film formation of the upper protective layer, the silicon content rate X, and consequently the relative proportions of iridium (Ir) and silicon (Si), is inclined in a layer direction, as described above, and the silicon (Si) content rate is made zero at the interface of contact with the adhesion improvement layer. For this reason, by adjusting the power applied from the power source 4006-1 to the target 4001-1, and from the power source 4006-2 to the target 4001-2, in accordance with an application time (that is, with the thickness of the layer being formed), the content rate or relative proportions are inclined. It is not absolutely essential to make the silicon content rate an inclined value. More specifically, provided that the conditions are met wherein the silicon attains the heretofore described content rate of 15 at. %≦X≦30 at. % at the interface where the upper protective layer comes into contact with the path forming member, while the silicon content rate becomes zero at the interface where the upper protective layer comes into contact with the adhesion improvement layer, how the content rate in the layer between the interfaces is increased and reduced is optional. In this case, it is also possible to realize the content rate by adjusting the power applied to the individual targets.

Referring again to FIGS. 4E and 5E, the pattern shown in these drawings is formed with the upper protective layer 107 and adhesion layer 109 formed in the way described above. To this end, using the photolithography method, the upper protective layer 107 and adhesion layer 109 are partially removed by means of a dry etching. Thereby, the upper protective layer area 107*a* on the heat generating portion 108, and the other upper protective layer area 107*b*, are formed.

Figure 4F:
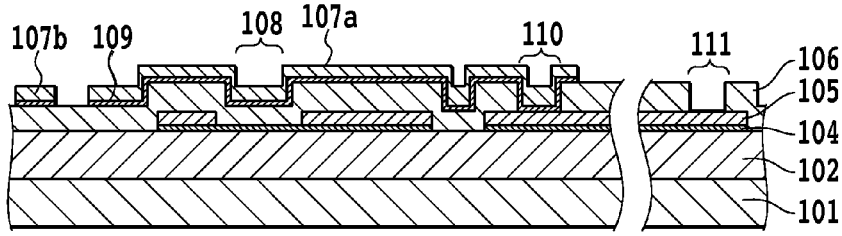

Next, in order to form the external electrode 111, the protective layer 106 is partially removed by means of a dry etching, using the photolithography method, partially exposing the electrode wiring layer 105 in that portion, as shown in FIG. 4F.

In the above described manufacturing process, the dry etching method is selected as a patterning method for the adhesion layer 109 and upper protective layer 107, but as the iridium used in the upper protective layer 107 has a slow etching rate, the process takes a long time. For this reason, it may be acceptable to use a liftoff method as the patterning method for the adhesion layer 109 and upper protective layer 107. In this case, a detachment member is disposed before the formation of the adhesion layer 109 and upper protective layer 107, and the patterning is performed using the photolithography method. At this time, the detachment member is formed in the areas in which the adhesion layer 109 and upper protective layer 107 are to be removed. Subsequently, the films of the adhesion layer 109 and upper protective layer 107 are formed, and the detachment member is stripped off using a solution, or the like. By this means, the pattern of the adhesion layer 109 and upper protective layer 107 is formed. As the detachment member, it is possible to use an inorganic material, or an organic material such as a resist agent.

FIGS. 7A to 7D are schematic sectional views illustrating a process of manufacturing the liquid ejection head using the above described substrate 100. Also, FIGS. 8A to 8D are also schematic sectional views illustrating a process of manufacturing the liquid ejection head according to another embodiment.

Figure 7A:
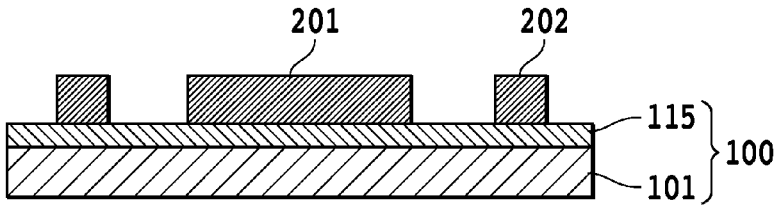
FIGS. 7A to 7D are schematic sectional views for illustrating one embodiment of a process of manufacturing the liquid ejection head using the heretofore described substrate.

A photo resist is applied, using a spin coat method, as soluble solid layers 201 and 202 for ultimately forming an ink path, on the liquid ejection head substrate 100, in which a circuit portion 115 including each above described layer is formed on the substrate. The resist material, being made of, for example, polymethyl isopropenyl ketone, is one which acts as a negative resist. Then, using a photolithography technique, the photo resist layer is patterned into the desired ink path shape, as shown in FIG. 7A.

Figure 8A:
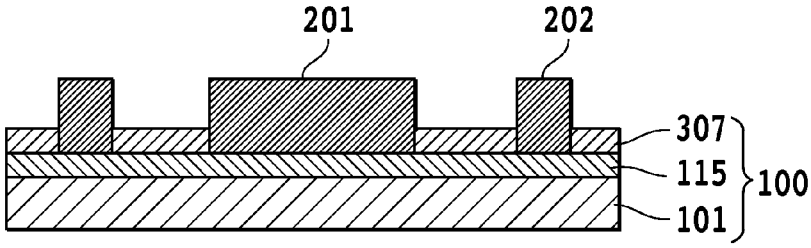
FIGS. 8A to 8D are schematic sectional views for illustrating another embodiment of a process of manufacturing the liquid ejection head using the heretofore described substrate.

Also, after forming the upper protective layer 107*a* (the $Ir_{100-X}Si_X$ film), it may be possible to form an organic adhesion improvement layer 307 between it and the path forming member, as shown in FIG. 8A. In such embodiment, a polyether amide resin is used as the organic adhesion improvement layer 307. This resin is particularly preferable as it has advantages such as having a superior alkali etching resistance, and also having a good adhesion with an inorganic film made of silicon or the like, and furthermore, it can also be used as an anti-ink protective layer in the liquid ejection head. Subsequently, using the photolithography technique, a patterning into, for example, the kind of shape shown in FIG. 8A is carried out. This patterning can be carried out using the same method as for the normal organic film dry etching. That is, with a positive resist as a mask, the etching can be carried out using an oxygen gas plasma.

Figure 7B:
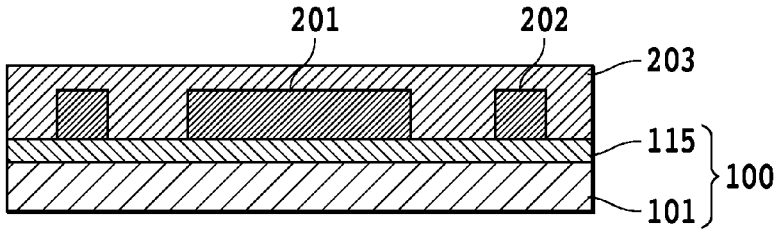
Figure 8B:
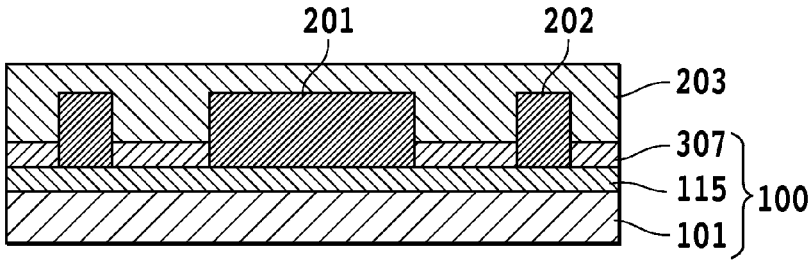

Continuing, as shown in FIGS. 7B and 8B, a coating resin layer 203 is formed in order to form a liquid path wall and the ejection opening 121 (FIG. 2), which form the path forming member 120 (FIG. 2). Before forming the coating resin layer 203, it may be possible to appropriately carry out a silane coupling process, or the like, in order to improve the adhesion. The coating resin layer 203 can be formed by appropriately selecting a conventionally known coating method, and applying resin on the ink jet head substrate 101 on which is formed an ink channel pattern.

Figure 7C:
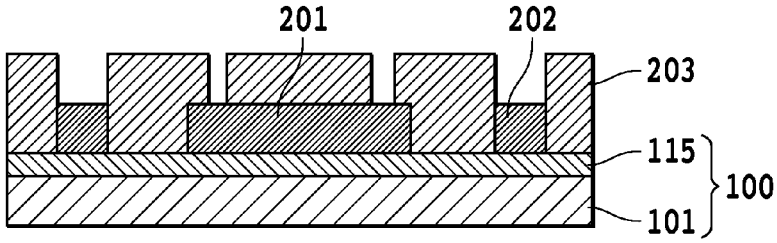
Figure 8C:
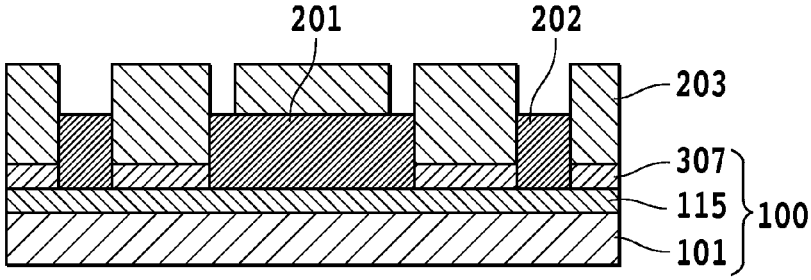

Next, using the photolithography technique, the coating resin layer 203 is patterned into the desired liquid path wall and ejection opening shapes, as shown in FIGS. 7C and 8C.

Figure 7D:
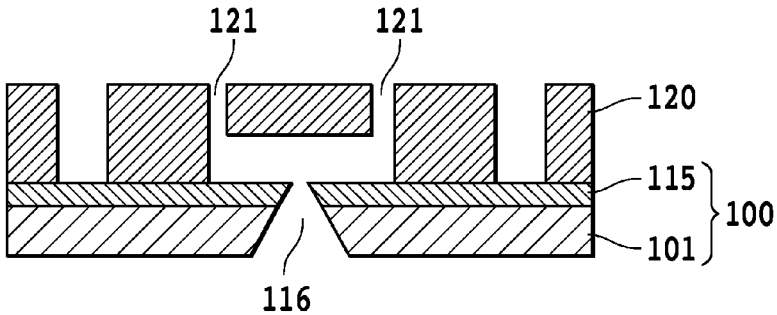
Figure 8D:
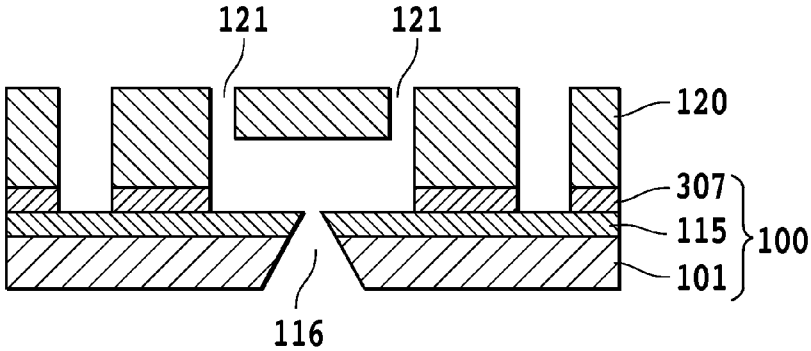

Subsequently, as shown in FIGS. 7D and 8D, an ink supply port 116 is formed from the rear surface of the substrate 100, using an anisotropic etching method, a sand blasting method, an anisotropic plasma etching method, or the like. Most preferably, it is possible to form the ink supply port 116 using a chemical silicon anisotropic etching method which uses tetramethyl ammonium hydroxide (TMAH), sodium hydroxide, potassium hydroxide, or the like. Continuing, the soluble solid layers 201 and 202 are removed by carrying out an overall exposure using a deep ultraviolet light, thus carrying out a development and drying.

The substrate in which the ejection unit is manufactured using the heretofore described process illustrated in FIGS. 7 and 8 is cut off using a dicing saw or the like, made into a chip, and an electrical connection for driving the heating resistor, and a joining with an ink supply member, are carried out, completing the liquid ejection head.

Figure 9:
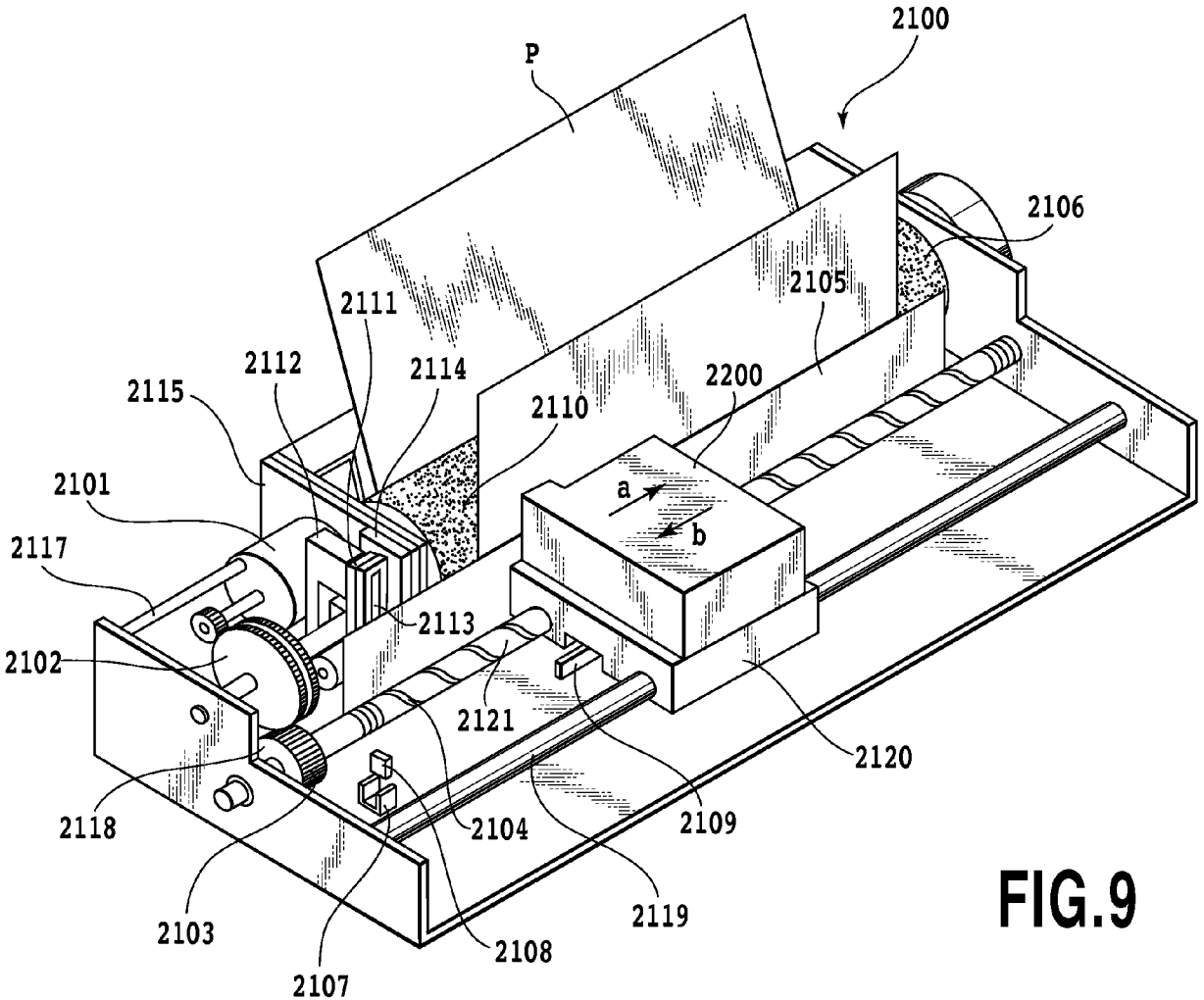
FIG. 9 is a perspective view showing one configuration example of an ink jet printing apparatus using the liquid ejection head according to the embodiment of the invention.

Also, FIG. 9 is a perspective view showing one example of an ink jet printing apparatus according to the embodiment of the present invention. In FIG. 9, a liquid ejection head 2200, manufactured in the way described above, is mounted on a carriage 2120 engaged in a spiral groove 2121 of a lead screw 2104 which rotates, via drive transmission gears 2102 and 2103, in conjunction with a forward/reverse rotation of a drive motor 2101. Then, by the carriage 2120 being moved back and forth, by the power of the drive motor 2101, along a guide 2119 in the directions of arrows a and b, it is possible to carry out a scanning for a printing. A paper pressing plate 2105 for printing paper P conveyed onto a platen 2106 by an not-shown printing medium supply device, presses the printing paper against the platen 2106 along a movement range of the carriage 2120.

2107 and 2108 are a home position detection section for confirming, with a photo coupler, the existence in the area of a lever 2109 of the carriage 2120, carrying out a switch in the rotation direction of the drive motor 2101, and the like. A reference numeral 2110 denotes a member supporting a cap member 2111, which caps a whole surface of the liquid ejection head 2200, while a reference numeral 2112 denotes a suction section for sucking and discharging ink inside the cap member 2111, carries out a suction recovery for the liquid ejection head 2200 via an aperture 2113 in the cap. A reference numeral 2114 denotes a cleaning blade, and a reference numeral 2115 denotes a movement member which enables a movement of the blade in a forward-back direction. These member are supported by a main body supporting plate. It goes without saying that, rather than this form of the cleaning blade 2114, it is possible to apply a well known cleaning blade to the main body.

Also, a reference 2117 denotes a lever for starting the suction of the suction recovery, it moves in accompaniment to a movement of a cam 2118 engaged with the carriage 2120, and the drive power from the drive motor 2101 is movement controlled by a known transmission section such as a clutch switch. A printing controller provided on the liquid ejection head 2200, which provides a signal to the heat generating portion, and conducts a drive control of each of the above described mechanisms, is provided on the printing apparatus main body side (not shown).

The ink jet printing apparatus 2100 with the above described kind of configuration carries out a printing on the printing paper P conveyed onto the platen 2106 by the printing medium supply device. That is, the liquid ejection head 2200 being such as to carry out a printing while moving back and forth over the whole width of the printing paper P, as the liquid ejection head 2200 used is one which has been manufactured using the above described method, a high precision, high speed printing is possible.

Hereafter, a description will be given of an embodiment of an evaluation of the film formation for the upper protective layer 107, of the liquid ejection head including the substrate on which the film formation has been carried out, and the like. Of course, the invention is not limited by this embodiment, or the like.

Using the apparatus shown in FIG. 6, and utilizing the above described film formation method, an iridium (Ir)-silicon (Si) thin film for the upper protective layer 107 is formed on a silicon wafer, and the film property is evaluated. The film formation operation and film property evaluation are as follows.

[Film Formation Operation]

Firstly, a thermally oxidized film is formed on a single crystal silicon wafer, and the silicon wafer (the substrate 4004) is set in the substrate holder 4003 inside the film formation chamber 4009 of the apparatus shown in FIG. 6. Next, using the air discharge pump 4007, air is discharged from the film formation chamber 4009 until the pressure is $8\times10^{-6}$ Pa. Subsequently, argon gas is introduced into the film formation chamber 4009 through the gas inlet 4010, making the conditions inside the film formation chamber 4009 as follows.

[Film Formation Conditions]

Substrate temperature: 150° C.

Ambient temperature of gas inside film formation chamber: 150° C.

Mixed gas pressure inside film formation chamber: 0.6 Pa

Next, using the iridium (Ir) target and silicon (Si) target, an $Ir_{100-X}Si_X$ film, with a thickness of 100 nm, is formed using the sputtering method on the thermally oxidized film of the silicon wafer, and samples 1 to 4 are obtained.

[Film Property Evaluation]

A Rutherford Back Scattering (RBS) analysis is carried out on the above described samples 1 to 4 obtained, and a composition analysis carried out for each sample. The results thereof are shown in Table 1.

TABLE 1

| Sample | DC Power (W) | | Silicon Content |
|---|---|---|---|
| Number | Iridium Target | Silicon Target | Rate (at. %) |
| 1 | 700 | 331 | 12.2 |
| 2 | 700 | 454 | 17.4 |
| 3 | 700 | 700 | 27.8 |
| 4 | 332 | 200 | 41.2 |

[Adhesion with Resin]

In order to simply evaluate the adhesion of the samples of number to 1 to 4, on which the upper protective layer of the embodiment is formed, with the organic adhesion improvement layer (the polyether amide resin) 307, which is a part of the path forming member, a tape removal test is carried out after a pressure cooker test (PCT).

The tape removal test is carried out in the following way. The organic adhesion improvement layer (the polyether amide resin) 307 is formed to a thickness of 2 μm on the silicon wafer on which the upper protective layer 107 is formed, and 100 (10 vertical and 10 horizontal) grid pattern sections each of which is 1 mm by 1 mm square are formed, using a utility knife, on the organic adhesion improvement layer 307. Next, the PCT test is carried out under conditions of being immersed in an alkali ink (BCI-7eC: produced by Canon) for 10 hours at 120° C., and 2.0265×105 Pa (2 atoms). Subsequently, tape is affixed to the above described grid pattern sections, a removal is carried out using the tape, and the number of the 100 sections removed by the tape is counted. The results thereof are shown in Table 2.

TABLE 2

| Sample Number | Silicon Content (at. %) | Number Removed (after PCT endurance test) | Evaluation |
|---|---|---|---|
| 1 | 12.2 | 100/100 | N.G. |
| 2 | 17.4 | 32/100 | O.K. |
| 3 | 27.8 | 17/100 | O.K. |
| 4 | 41.2 | 0/100 | O.K. |

In the way described above, for the $Ir_{100-x}Si_x$ film, the adhesion of the upper protective layer 107*a* with the organic adhesion improvement layer 307, after carrying out the PCT test, has a tendency to decrease with a film which has a low silicon content rate, and the silicon content rate at which the number of sections removed is 50 or less is 15%.

[Electrochemical Reaction with Electrolyte (Ink)]

Figure 10:
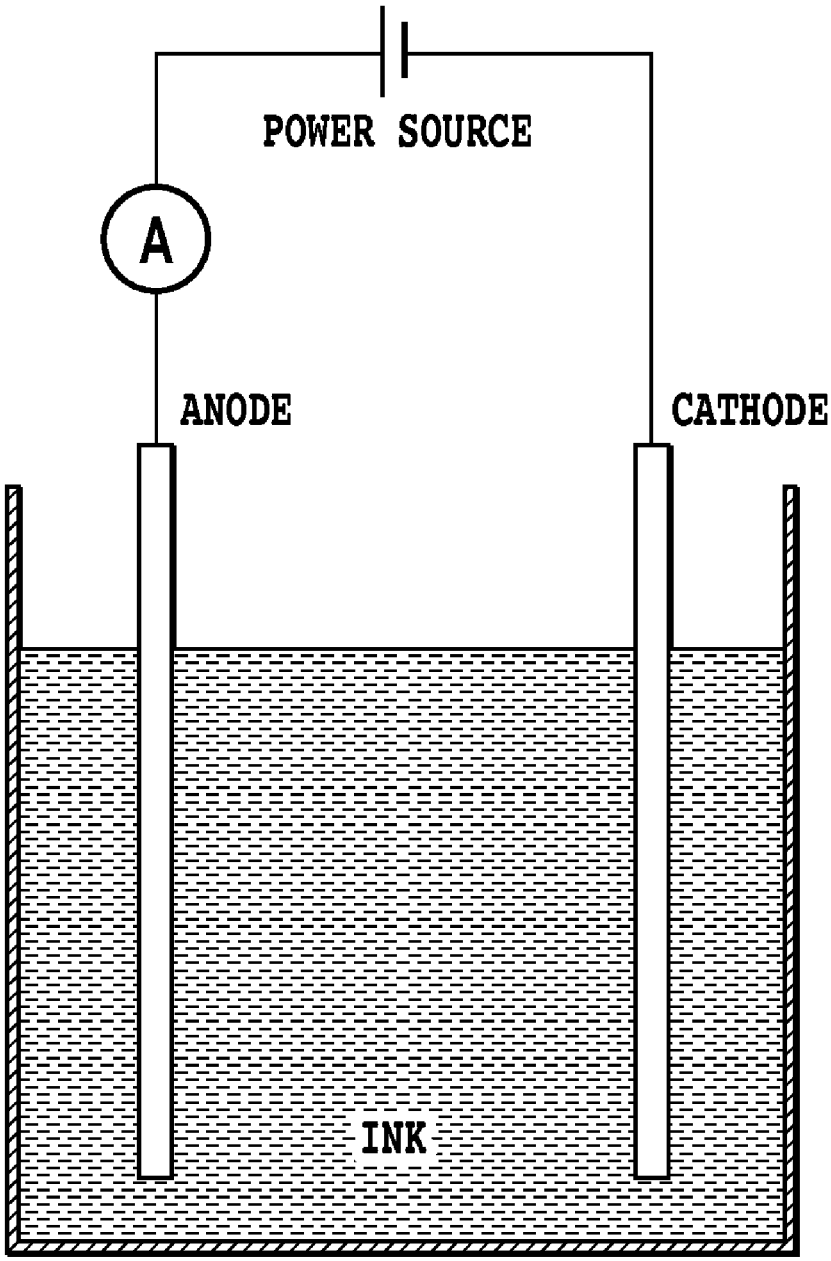
FIG. 10 is a schematic view showing an electrochemical reaction elution evaluation test.

In order to evaluate the elution due to the electrochemical reaction between the samples numbered 1 to 4 of the embodiment and the ink (BCI-7eC: produced by Canon), opposing electrodes are provided, as shown in FIG. 10. Then, by disposing the samples of the embodiment, of each of which a part is masked, at an anode side, and applying 24V by the power source, the reaction occurring on the anode side is judged to be the occurrence of an etching in the case that the film thickness decreases, and conversely, the occurrence of an anode oxidation in the case that the film thickness increases. The results thereof are shown in Table 3.

TABLE 3

| Sample Number | Silicon Content (at. %) | Electrochemical Reaction | Judgment |
|---|---|---|---|
| 1 | 12.2 | Etching | O.K. |
| 2 | 17.4 | Etching | O.K. |
| 3 | 27.8 | Etching | O.K. |
| 4 | 41.2 | Anode oxidation | N.G. |

As described above, for the $Ir_{100-x}Si_x$ film, the electrochemical reaction with the ink is such that there is a tendency for the etching phenomenon to decrease, and for the anode oxidation to occur, as the silicon content rate increases, and the result is good when X is 30 at. % or less, and preferably 27.8 at. % or less.

From the results of the above described adhesion and electrochemical reaction, the condition under which it is possible to cause the surface layer of the protective layer to be eluted due to the electrochemical reaction, and evenly and thoroughly remove the cogation on the heat application portion, is that the silicon content rate is 30 at. % or less, and that the lower the silicon content rate the better. Conversely, the condition for improving the adhesion of the upper protective layer with the resin layer, which is the path formation member, is that the adhesion is good when the silicon content rate is 15 at. % or more. As a result, the upper protective layer which satisfies both points, having a good electrochemical reaction and improving the adhesion of the upper protective layer with the resin layer, is the one described below. The upper protective layer is one in which the silicon content rate X of the $Ir_{100-x}Si_x$ film is greatest at the portion in contact with the ink or at the portion adhering to the resin layer, and the greatest value satisfying 15 at. %≦X≦30 at. %. That is, the silicon content rate becomes the greatest value between the ranges of 15 at. % to 30 at. %, at the adhesion portion with the resin layer, and becomes zero at the interface with the adhesion layer on the side opposite to the above described resin layer. Thereby, it is possible to stabilize the long-term ejection property of the liquid ejection head.

The preferable range of the above described silicon content rate varies depending on the ink used and the specifications of the liquid ejection head. Consequently, the preferable range of the silicon content rate is fixed by, for example, carrying out the above described evaluation, causing it to be compatible with the ink, liquid ejection head specifications, and the like. That is, the upper protective layer of the embodiment of the present invention is one which is formed including a predetermined amount of silicon, fixed based on an evaluation, in the metal iridium (Ir) or ruthenium (Ru).

Also, in the embodiment, the protective layer area 107*b* is used as the cathode electrode when performing the electrochemical reaction. That is, the protective layer area 107*b* is also formed using a film of the same configuration. However, it is also acceptable to form the protective layer area 107*b* using another material, provided that it is one with which it is possible to perform a preferable electrochemical reaction through the solution (the ink).

[Evaluation for Liquid Ejection Head]

A case will be shown wherein a film in which, for example, the composition of the surface in contact with the ink, and of the portion adhering to the resin layer, has a composition rate of $Ir_{82.6}Si_{17.4}$ is used as the upper protective layer 107.

In the embodiment, using a two-dimensional sputtering method which uses the Ir target and the Si target, an IrSi film with a thickness of 230 nm is formed, inclining the composition rate. In the embodiment, the DC power applied to the Ir target is fixed at 700 W, while the DC power applied to the Si target is gradually increased from 0 W, with 454 W ultimately being applied. Thereby, the film of the upper protective layer 107*a* is formed in such a way that the composition of the surface in contact with the ink, and of the portion adhering to the resin layer, is $Ir_{82.6}Si_{17.4}$.

Subsequently, a pattern formation of the $Ir_{82.6}Si_{17.4}$ film is carried out, using a general photolithography process, in the order of resist patterning (photo-resist application, exposure, development), $Ir_{82.6}Si_{17.4}$ film etching, and photo-resist removal.

At this time, it is possible to select a desired pattern as the pattern of the $Ir_{82.6}Si_{17.4}$ film, using a photo-mask pattern at the time of exposure.

Subsequently, by applying the soluble solid layers 201 and 202 on the substrate on which the upper protective layer 107 is formed, using the spin coat method, and exposing them, the shape which is to be the ink channel is manufactured. The shape of the ink channel can be obtained using a normal mask, and a deep ultraviolet light. Subsequently, the ejection opening 121 is formed by developing after laminating the coating resin layer 203, and exposing using an exposure device. Continuing, after forming the ink supply port 116 using the chemical silicon anisotropic etching method, with TMAH, the portion of the coating resin layer 203 to be dissolved is removed by irradiating all over with a deep ultraviolet light, developing, and drying. According to the above described process, the substrate on which a nozzle is formed is cut off using a dicing saw or the like, made into a chip, and an electrical connection for driving the heating resistor, and a joining with an ink supply member, are carried out, completing the liquid ejection head.

When a an ejection printing evaluation is made for a pH 10 alkali ink using the liquid ejection head manufactured here, it is possible to obtain an article of a good printing quality. Also, when an ejection printing evaluation is carried out after immersing the ink jet head in the ink at 60° C. for three months, as well as being able to obtain an article of a good printing quality, there is no evidence of a reduction in the removal of the coating resin layer 203 or the cogation removal effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-164852, filed Jun. 24, 2008 which is hereby incorporated by reference herein in its entirety.

What is claimed is:

1. A liquid ejection head having an ejection opening for ejecting a liquid, comprising:

a substrate;

a heat generating portion for generating thermal energy used for ejecting the liquid from the ejection opening, the heat generating portion being provided on the substrate;

a first layer that is provided on said heat generating portion and is made of an insulating material;

a second layer that is provided on said first layer in a laminated condition and is made of a metallic material; and a member that is provided so as to be in contact with said second layer, forms a liquid path communicating with the ejection opening, and is made of a resin, wherein each of at least two portions of said second layer, one of which corresponds to said heat generating portion and the other of which is in contact with said member, contains iridium (Ir) and silicon (Si), or contains ruthenium (Ru) and silicon (Si).

2. A liquid ejection head as claimed in claim 1, further comprising an electrode that is exposed to the liquid path and is electrically connected to said second layer.

3. A liquid ejection head as claimed in claim 1, wherein a content rate of Si at the portion of said second layer, which is in contact with said member, falls within ranges of 15 at. %-30 at. %.

4. A liquid ejection head as claimed in claim 1, wherein said second layer is provided so that the portion of said second layer, which corresponds to said heat generating portion, and the portion of said second layer, which is in contact with said member, connect with each other.

5. A liquid ejection head as claimed in claim 1, wherein a content rate of Si of the said second layer is made zero at a surface of said second layer which is in contact with said substrate.

6. A liquid ejection head as claimed in claim 1, wherein a content rate of Si of said second layer decreases from a surface of said second layer at a side of said member to a surface of said second layer a side of said substrate.

7. A liquid ejection head as claimed in claim 2, wherein a voltage is applied between said electrode and said second layer so that the portion of said second layer, which corresponds to said heat generating portion, is eluted by an electrochemical reaction.

* * * * *